United States Patent [19]

Neumann et al.

[11] Patent Number: 4,752,253

[45] Date of Patent: Jun. 21, 1988

[54] CONTACT ELEMENT AND METHOD OF MANUFACTURING

[75] Inventors: Gerhard Neumann, Waldkraiburg; Paul-Rainer Molitor, Muhldorf, both of Fed. Rep. of Germany

[73] Assignee: Otto Dunkel GmbH, Muhldorf, Fed. Rep. of Germany

[21] Appl. No.: 25,209

[22] Filed: Mar. 12, 1987

[30] Foreign Application Priority Data

Mar. 12, 1986 [DE] Fed. Rep. of Germany ..... 3608276

[51] Int. Cl.[4] ..... H01R 13/05

[52] U.S. Cl. ..... 439/825; 439/851

[58] Field of Search ..... 439/825, 842, 851

[56] References Cited

U.S. PATENT DOCUMENTS

| | | | |
|---|---|---|---|
| 3,023,789 | 3/1962 | Bonhomme | 140/93 |
| 3,319,217 | 5/1967 | Phillips | 439/825 |
| 4,203,647 | 5/1980 | Bonhomme | 439/851 |
| 4,572,606 | 2/1986 | Neuman et al. | 339/262 |

FOREIGN PATENT DOCUMENTS

| | | | |
|---|---|---|---|
| 2558003 | 6/1977 | Fed. Rep. of Germany | 178/25 |

*Primary Examiner*—Joseph H. McGlynn

*Attorney, Agent, or Firm*—Holman & Stern

[57] ABSTRACT

A contact element in the form of a spring contact jack or spring plug pin has a plurality of mutually laterally disposed spring contacts which can be attached at one end to a support piece and which are radially curved in order to provide contact with an opposing contact; and further relates to a method of manufacturing the contact element.

12 Claims, 2 Drawing Sheets

1
2
3
4
5
6
7
8
10
11
12
13
14
14
15
16
17
18
19
19

CONTACT ELEMENT AND METHOD OF MANUFACTURING

BACKGROUND OF THE INVENTION

The present invention relates to a contact element in the form of a spring contact jack or spring plug pin, with a plurality of mutually laterally disposed spring contacts which can be attached at one end to a support piece and which are radially curved in order to provide contact with an opposing contact; and the invention further relates to a method of manufacturing said contact element.

It is known from German OS No. 25 58 003 to employ, in manufacturing spring contact jacks, a spring contact mat comprised of spring contact wire curved in a meander shape or "wave shape". In this contact spring mat the segments of contact spring wire, which run parallel to each other, are connected by arcuate segments. This configuration has turned out to be disadvantageous in that there is a practical lower limit to the radius of curvature, and thereby a lower limit to the separation of the contact spring wire segments. Wholly apart from the fact that said mat is difficult to manipulate due to its unavoidable expandability, it has proven disadvantageous that the arcuate segments resist bending around an axis parallel to the spring contact wire segments. Thus, in order to bend the mat into a permanent cylindrical shape, it is necessary to distort the spring contact wire segments; and further it is not practically possible to predict the degree of such distortion. Thus, spring contact jacks with meander-shaped preformed spring contact wire have not proven feasible in practice, particularly not in miniature applications.

In manufacturing spring contact jacks having small dimensions (German Pat. No. 3,342,742 and U.S. Pat. No. 4,572,606 corresponding thereto) one also employs spring contact wire segments which are individually mounted in a jack body. The prefabricated tubes which serve as the jack bodies are manufactured efficiently by drawing. They have wall thickness on the order of 0.1 mm and are easily deformed from outside. After the contact springs are inserted, the jacks are each provided with a radially inwardly extending, ring-shaped ridge-like projection or bead, at each of two axially separated loci (axially with respect to the ring-shaped body or ring-shaped shoulder or the like). The ring-shaped ridge-like projections come to abut the spring contacts and cause said springs to curve radially inward.

In the manufacture of a spring contact jack of a different structure (U.S. Pat. No. 3,023,789), wherein individual contact springs are employed, spring contacts are disposed along peripheral lines of a hyperboloid of rotation, in a rigid sleeve, and their bent-around ends are pressed against the end of the sleeve. Contact spring jacks manufactured according to this method do in fact enable the desired miniaturization. However, they have the following drawbacks:

the spring ends cannot be galvanically anodized or otherwise galvanically finished;

very strict tolerances are imposed between the plug and the jack, particularly in light of the unfavorable spring characteristic curve; and only relatively few spring contacts can be installed, whereby the current passed will thus be limited.

SUMMARY OF THE INVENTION

The underlying problem in the prior art is to devise a simple and economically manufacturable spring contact element of the type described initially supra, whereby multiple pin (or multiple plug) connections can be manufactured which are compact, pass high currents, and nonetheless have small plug insertion forces.

The inventive contact element which solves this problem is essentially distinguished in that the spring contacts, formed by cutting a spring contact wire, are interconnected at at least one of their ends to form a mat-like spring contact assembly, said interconnection being transverse to their longitudinal direction, and are converted to a radially curved state; and in that the said assembly is rolled into an essentially cylindrical shape, which shape can be easily mounted onto the support piece by clamping means or the like.

The inventive contact element provides the manufacturing advantage that the spring contacts do not need to be supplied individually to be i.e., mounted individually on a sleeve body. By prefabricating a spring contact "mat" comprised of segments of spring contact wire which are connected via their ends, one avoids the major problem which was presented when a meander-type spring contact mat was used, namely the difficulty of producing a cylindrical shape, because in contrast to the prior meander-type mat, in the present invention no arcuate regions of connecting wire are present which resist forming of the mat into a cylindrical shape. Also, generally no torsional stress is applied to the spring contact wire segments in the spring contact mat during the forming of the cylindrical shape. Further, problem-free radial (with respect to the cylindrical shape into which the mat is rolled) curving of the spring contact wire segments is ensured. The contact element having the characteristic structure comprises the essential component in the manufacture of contact jacks and contact plug pins which yield trouble-free contact behavior with minimal contact resistance while at the same time requiring only relatively low plug force in plugging in and out. The inventive contact element is thus particularly suitable for multiple-plug connectors.

It has proven very advantageous with regard to the electrical properties of the contact element if the interconnection of the spring contacts on their one end is of a metallic conducting type. From a manufacturing standpoint it is advantageous if laser welding is used to interconnect the spring contacts to form the mat-like spring contact assembly. An embodiment is of special practical interest wherein the spring contacts are interconnected by an edge band running transverse to their ends. Advantageously, this interconnection of the ends of the spring contacts is accomplished by two edge bands, one for each end of the spring contacts in the array.

The edge band may be comprised of an ordinary ring-shaped i.e., toroidal length of wire, which wire may be flattened on the side thereof which faces the end faces of the spring contact segments. Advantageously, however, the edge band is in the form of a profile the exterior surface of which forms an acute angle with the axis of the spring contact wire segments, whereby when the given contact element approaches the opposing contact the profile brings about accurate alignment of the contact element with respect to the opposing contact.

A particularly stable and secure embodiment results if the edge band is in the form of a U-profile copper band wherewith the ends of the spring contacts arranged in a row are included between the two legs of the "U".

A further object of the invention is a method of manufacturing a contact element, said method being characterized by the following method steps:

disposing spring contact wire segments of uniform length at a predetermined distance apart and mutually parallel;

feeding an edge band to a location at at least one end of each of the spring contacts and joining the spring contacts to the edge band while the spring contacts are being conveyed transversely to their axes, whereby a spring contact "mat" is formed;

forming each of the spring contacts into an arcuate "radially arcuate" shape transversely to the plane of the spring contact mat;

applying a galvanic coating;

cutting the edge bands to form spring contact assemblies; and converting said assemblies into cylindrically rolled form.

It has proven advantageous in this connection to apply a galvanic gold coating (gold electroplate) to the exterior side of the arcuate regions, which regions serve for current passage in the connector means being manufactured, prior to the cylindrical rolling of the spring contact assemblies.

BRIEF DESCRIPTION OF THE DRAWINGS

Other characteristics, advantages, and features of the invention will be seen from the following description and from the drawings. For purposes of disclosure, all characteristics revealed solely in the drawings are expressly incorporated in the Specification by reference.

DETAILED DESCRIPTION OF THE INVENTION

Figures 1, 2, 3, 4, 5:
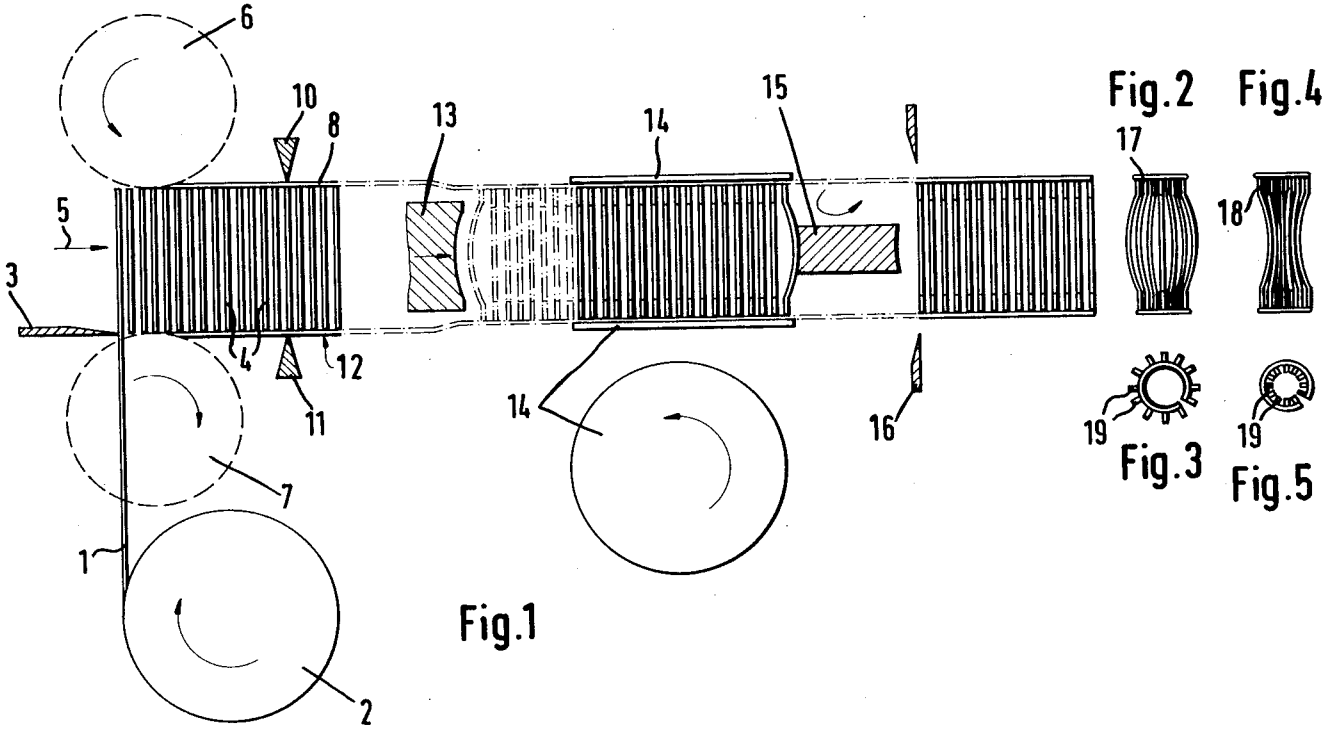
FIG. 1 is a schematic representation of the method steps in the fabrication of a contact element according to the present invention, along with a transverse elevational view of a conveying roll 14.
FIGS. 2 and 3 are a side view and a plan view, respectively, of a contact element in the form of a spring plug pin.
FIGS. 4 and 5 are a side view and a plan view, respectively, of a contact element in the form of a spring contact jack.

As seen from FIG. 1, a copper-beryllium alloy spring contact wire 1 which is employed in the contact elements is supplied by a reel 2 and is cut to length (segments 4) with a cutter 3. Then the segments are conveyed in the direction of arrow 5 transversely to their axial direction, by a conveying means not illustrated. An edge band 8 is fed from a reel 6, and similarly, an edge band 9 is fed from a reel 7 at the same speed of conveying of the segments 4 as indicated by the arrow 5, and is aligned with the arrayed ends of the segments 4, which segments 5 are being conveyed such that they are each spaced a predetermined distance apart. The ends of the spring contacts 4 are then joined to the edge bands 8, 9 at joining stations 10, 11 (shown schematically in FIG. 1). The joining is accomplished by welding, preferably laser welding, whereby the so joined spring contacts form a "mat" 12.

In the conveying path there are disposed bending and forming presses, one of which (press 13) is shown schematically in a position which has been rotated 90 degrees about a vertical axis. With the aid of this press 13 the spring contacts 4 are given a radial curvature transverse to the plane of the spring contact mat 12 (and in a direction which is normal to the plane of FIG. 1), whereby the distance between the edge bands 8 and 9 is correspondingly decreased as seen by the transition region of the mat 12 in the vicinity of the press 13. The mat 12 next passes through a galvanic station having pickup and conveying rolls 14 which are illustrated schematically in FIG. 1. In, e.g., a nickel-coated state, the mat 12 receives, e.g., gold plating, with the aid of a wetting apparatus 15 (shown schematically) which may comprise, e.g., a titanium electrode with a textile covering for wetting the contact locations. A mat segment of desired length is then separated from the spring contact mat 12, with the aid of a cutting device 16, shown schematically in FIG. 1. In the next step, the mat segment is rolled cylindrically. The resulting contact element has either the shape of a spring-loaded plug pin 17 (FIGS. 2 and 3) or a spring contact jack 18 (FIGS. 4 and 5). In the case of the plug pin 17, the rolling process is carried out so as to produce outwardly directed radial curved lengths 19 (i.e., with the curved lengths convex outwardly) as seen in FIGS. 2 and 3, and in the case of the jack 18 the process is carried out so as to produce inwardly directed radial curved lengths 19' in FIG. 5.

Figure 7:
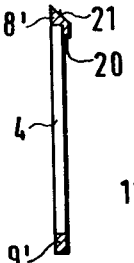
FIG. 7 is a cross section through a spring contact element with an edge band formed by a profile wire i.e., a fine profile.
Figure 6:
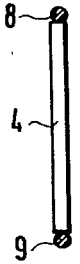
FIG. 6 is a cross section through a spring contact element with an edge band formed by a round wire.

FIG. 6 shows how the spring contact wire segments 4 are each connected to edge bands 8, 9 in the form of a round wire. Profiles 8', 9' may also be used as edge bands, as shown in FIG. 7. Band 9' has a rectangular shape, while band 8' is shaped such that its lateral shoulder 20 rests laterally against the segments 4. The resulting widening of the edge band 8', which widening involves the inclined exterior surface 21 which makes an acute angle with the axis of the contact springs 4, ensures that if the opposite contact (not shown) is approached eccentrically the contact elements will be accurately aligned.

Figure 8:
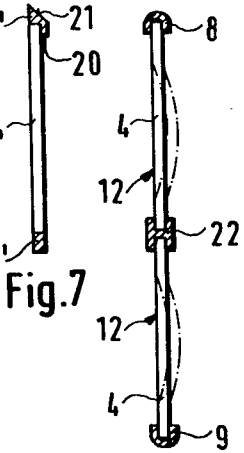
FIG. 8 is a cross section through a spring contact element assembled into a double unit from two single spring contact units.

In FIG. 8 a refinement is shown wherein the edge bands 8, 9 are in the form of a U-shaped copper band, wherewith the ends of the spring contacts 4 arranged in a row are included between the two legs of the "U". FIG. 8 also illustrates the possibility of combining two mat-like spring contact assemblies via a common edge band 22 between them, to form a double assembly which can be used as a double jack.

Figure 9:
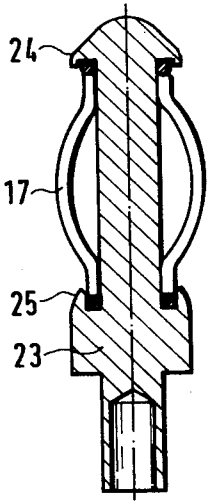
FIG. 9 is a cross section through a support rod with a contact element attached to it, forming a spring plug pin.

FIG. 9 shows, very schematically, how the contact element 17 in the form of a spring-loaded plug pin may be disposed on a support rod 23. Beaded edges 24 and 25 serve to hold the spring-loaded plug pin 17 in place.

Figure 11:
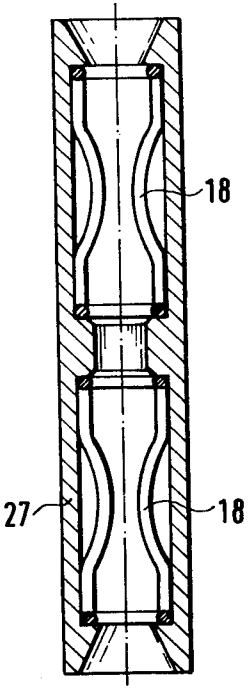
FIG. 11 is a cross section through a two-support sleeve with two contact elements attached inside it, each combination of support sleeve and contact element forming a spring contact jack.
Figure 10:
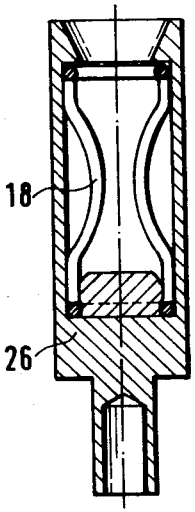
FIG. 10 is a cross section through a support sleeve with a contact element attached inside it, forming a spring contact jack.

FIG. 10 shows the possibility of disposing the contact element, which is here in the form of a spring contact jack 18, in a support sleeve 26. FIG. 11 shows coaxial fixing of two spring contact jacks 18, 18 within a common dual support sleeve 27.

Support rod 23 and support sleeves 26 and 27, as seen in FIGS. 9–11, are turned pieces which are manufactured in customary fashion. In particular, in miniature fittings, where the spring contacts 4 are only about 0.1 mm thick, it is possible to insert the contact elements, which are, e.g., in the form of spring contact jacks 18, into sleeves prefabricated by drawing, wherewith the contact elements are mounted in said sleeves by simple beading over of the sleeve edges. This can also be accomplished in connection with pressing of the one edge of the sleeve onto a support rod having a relatively simple shape.

While preferred embodiments have been shown and described, it will be understood that the present invention is not limited thereto, but may be otherwise embodied within the scope of the following claims.

What is claimed is:

1. An electrical contact element, comprising a cylindrically-shaped spring contact assembly of a plurality of mutually laterally parallely disposed longitudinally extending spring contacts, said spring contacts being of spring contact wire, said spring contacts each being interconnected at at least one end thereof by a support piece attached thereto, said support piece extending transversely of said longitudinal extent of said spring contacts, said spring contacts and said support piece forming a mat-like contact assembly, said mat-like contact assembly being rolled around a longitudinal axis parallel to said longitudinal extent of said spring contacts and forming thereby said cylindrically-shaped spring contact assembly, each of said plurality of spring contacts being curved radially transversely of said longitudinal axis for providing a curved contact area for engaging a corresponding opposite contact element.

2. A contact element according to claim 1, wherein the interconnection of the spring contacts on their one end is of a metallic conducting type.

3. A contact element according to claim 1, wherein laser welding is used to interconnect the spring contacts to form the mat-like spring contact assembly.

4. A contact element according to claim 1, wherein said spring contacts are curved radially outwardly in a direction transversely of said longitudinal axis, whereby a spring-loaded plug pin is provided.

5. A contact element according to claim 1, wherein said spring contacts are curved radially inwardly in a direction transversely of said longitudinal axis, whereby a spring contact jack is provided.

6. A contact element, according to claim 1, wherein the spring contacts are interconnected with the aid of an edge band running transverse to said spring contacts ends.

7. A contact element according to claim 6, wherein the edge band is in the form of a profile shaped wire the exterior surface of which forms an acute angle with the axis of the spring contact wire segments.

8. A contact element according to claim 6, wherein the edge band is in the form of a U-profile copper band wherewith the ends of the spring contacts arranged in a row are included between the two legs of the "U".

9. A contact element according to claim 6, wherein interconnection of the ends of the spring contacts is by means of two edge bands, one for each end of the spring contacts.

10. A contact element according to claim 9, wherein two mat-like spring contact assemblies are combined via a common edge band between them, to form a double assembly which can be used as a double jack.

11. A method of manufacturing electrical contact elements, comprising the following steps:

disposing spring contact wire segments of uniform length at a predetermined distance apart in a mutually parallel array;

feeding an edge band to a location at at least one end of the spring contacts in the aforesaid array and joining the spring contacts to the edge band while the spring contacts are being conveyed transversely to their longitudinal axes, whereby a spring contact mat is formed;

forming each of the spring contacts into an arcuate shape transversely to the plane of the spring contact mat;

applying a galvanic coating to arcuate regions of said spring contacts;

cutting the edge bands to form spring contact assemblies; and converting said spring contact assemblies into cylindrically rolled form.

12. A method according to claim 11, wherein a galvanic gold coating is applied to an exterior side of the arcuate regions, which regions serve for current passage, prior to the cylindrical rolling of the spring contact assemblies.

* * * * *